US005520573A

United States Patent [19]

Sumita et al.

[11] Patent Number: 5,520,573

[45] Date of Patent: May 28, 1996

[54] SPHERICAL MEMBER POLISHING APPARATUS

[75] Inventors: Yuichi Sumita; Gentei Inoue, both of Kanagawa, Japan

[73] Assignee: NSK Ltd., Tokyo, Japan

[21] Appl. No.: 447,241

[22] Filed: May 22, 1995

[30] Foreign Application Priority Data

May 20, 1994 [JP] Japan ..... 6-130946

[51] Int. Cl.[6] ..... B24B 7/00

[52] U.S. Cl. ..... 451/262; 451/50; 451/488; 451/548

[58] Field of Search ..... 451/50, 268, 282, 451/283, 286, 262, 284, 488, 548, 450, 449

[56] References Cited

U.S. PATENT DOCUMENTS

| | | | |
|---|---|---|---|
| 3,660,942 | 5/1972 | Messerschmidt | 451/50 |
| 3,791,083 | 2/1974 | Messerschmidt | 451/50 |
| 3,847,000 | 11/1974 | Teague | 451/50 |
| 3,932,966 | 1/1976 | Stern | 451/488 |
| 4,216,629 | 8/1980 | DeGaeta | 451/50 |
| 4,965,967 | 10/1990 | London . | |
| 5,214,884 | 6/1993 | Kinoshita et al. . | |
| 5,400,547 | 3/1995 | Tanaka et al. | 451/488 |
| 5,454,752 | 10/1995 | Sexton et al. | 451/548 |

FOREIGN PATENT DOCUMENTS

| | | | |
|---|---|---|---|
| 5-57602 | 3/1993 | Japan | B24B 37/02 |
| 2259036 | 3/1993 | United Kingdom . | |
| 8808771 | 11/1988 | WIPO . | |

*Primary Examiner*—Bruce M. Kisliuk
*Assistant Examiner*—Andrew Weinberg
*Attorney, Agent, or Firm*—Sughrue, Mion, Zinn, Macpeak & Seas

[57] ABSTRACT

A spherical member polishing apparatus has a fixed disk which is disposed in opposition to a rotating disk with a predetermined clearance. The rotating disk is rotated, and spherical members are clamped and pressurized between the rotating disk and the fixed disk for roll-polishing the spherical members. A plurality of grooves are formed along a circumferential direction of the fixed disk, and a plurality of working-fluid supply ports are randomly formed along the circumferential direction between the grooves, between the groove and an outer peripheral portion of the fixed disk, and between the groove and an inner peripheral portion of the fixed disk. The working fluid is supplied through the working-fluid supply ports to the fixed disk. A large number of spherical members are polished at a high precision, while a variation in polishing precision and the like are avoided as much as possible.

6 Claims, 8 Drawing Sheets

SPHERICAL MEMBER POLISHING APPARATUS

BACKGROUND OF THE INVENTION

The present invention relates to a spherical member polishing apparatus, and more particularly to a spherical member polishing apparatus for polishing the surfaces of spherical members to be worked so as to realize perfect sphericity (hereinafter, such spherical members to be worked are referred to as merely "spherical members").

As shown in FIG. 10, a conventional spherical member polishing apparatus includes a storage 52 for storing a plurality of spherical members 51, a rotating disk 53 which is tilted at a predetermined angle α with respect to the storage 52, and a fixed disk 54 which is disposed in opposition to the rotating disk 53 with a predetermined clearance therebetween (for example, see Unexamined Japanese Patent Publication No. HEI. 5-57602).

In the spherical member polishing apparatus, the spherical members 51 which are stored in the storage 52 are supplied between the rotating disk 53 and the fixed disk 54 via a spherical member loading chute 55. During the one-round travel of the spherical members 51 between the rotating disk 53 and the fixed disk 54 in the circumferential direction, the spherical members 51 are pressurized and polished between the disks 53 and 54, and then discharged via a spherical member discharging chute 56 so as to be recovered into the storage 52.

It is also known in the background art for the other conventional apparatus of a type in which both the rotating disk 53 and the fixed disk 54 are made of hard cast iron, and unhardened spherical members are polished without using abrasive grains, and that in which the rotating disk 53 is made of a grindstone and the fixed disk 54 is made of cast iron so as to polish the spherical members 51 after hardening.

In the conventional spherical member polishing apparatus, as shown in FIG. 11A, the fixed disk 54 includes a plurality of grooves 57*a*, 57*b*, 57*c* which are concentrically formed on the disk, and working-fluid feed pipes 58*a* and 58*b* each having an open end are disposed above the fixed disk 54 and in the vicinity of the spherical member loading chute 55. A predetermined amount of working fluid is supplied between the disks 53 and 54 from a working-fluid supplying apparatus 59 shown in FIG. 11B. Specifically, the working-fluid supplying apparatus includes a tank 61 for storing working fluid 60, the working-fluid feed pipes 58*a* and 58*b* for supplying the working fluid 60 between the disks 53 and 54, a hydraulic pump 62 interposed in the working-fluid feed pipes 58*a* and 58*b*, and a recovering unit 63 for recovering the working fluid 60 discharged from the working-fluid feed pipes 58*a* and 58*b* into the tank 61. The working fluid 60 supplied between the disks 53 and 54 applies a cooling function to the spherical members 51 which generate heat due to the frictional heat caused by roll polishing, and is then recovered into the tank 61 via the recovering unit 63.

As another polishing method which uses a spherical member polishing apparatus including the above-mentioned working-fluid supplying apparatus 59, it is also known in that free abrasive grains are suspended in the tank 60, and the free abrasive grains are made to be accompanied with the working fluid 60. Thus, the free abrasive grains are supplied between the disks 53 and 54, so as to polish the spherical members 51.

As described above, in the conventional spherical member polishing apparatus, when the spherical members 51 which are stored in the storage 52 are introduced between the two disks 53 and 54, the spherical members roll and travel first downwardly, and then upwardly against gravity. Thereafter, the spherical members roll and travel downwardly again, so as to be recovered in the storage 52 through the spherical member discharging chute 56. However, since the rotating disk 53 and the fixed disk 54 are tilted as shown in FIG. 10, the working fluid 60 tends to accumulate in the lower portion.

In addition, in the spherical member polishing apparatus, the lower side is open. Therefore, if the working fluid 60 is supplied in the vicinity of the spherical member loading chute 55 or from above of the fixed disk 54, then the working fluid 60 may leak out from the lower portion, or the spherical members 51 may roll and travel upwardly with a reduced amount of working fluid 60. This results in a drawback in that the working fluid 60 cannot be effectively and sufficiently supplied to all points of working spherical members between the two disks 53 and 54.

That is, in the above-described spherical member polishing apparatus, particularly in the case where a plurality of (e.g., 20 or more) grooves 57 are formed on the fixed disk 54, and a large amount of spherical members 51 are polished at one time, for example, in the case where 1,000 spherical members are simultaneously polished, there exist 2,000 to 3,000 working points. However, the working fluid 60 cannot be distributed in the grooves 57 uniformly. This causes a drawback in that the working fluid 60 cannot be effectively and sufficiently supplied to all the working points. Even in the case where the temperature of the working fluid exhibits an average temperature rise of about 50° to 70° C., an extraordinary high temperature is locally realized in some of, for example, 1,000 spherical members which roll between the two disks 53 and 54, because of the shortage of the working fluid 60. This results in such problems that the quality of metallic structure of the spherical members 51 is partly deteriorated so that the surface hardness is lowered.

In addition, in the case where the polishing is performed with using a grindstone as the rotating disk 53, there arise problems in that a long time is required to conform the size and shape of the groove 57 to those of the spherical members 51, because of the high hardness of the grindstone, and that it is difficult to appropriately control the sharpness of the grindstone during the polishing process.

Also in the case where the polishing is performed with using free abrasive grains, the working fluid containing the abrasive grains is not uniformly supplied into the plurality of concentric grooves, so that some of the spherical members 51 are polished with high precision and some are not sufficiently polished. This causes such drawbacks as an error in size and a variation of polishing precision. As a result, there exists a problem in that a fine finishing process is necessary to perform as a next process using working fluid which does not contain abrasive grains, thereby improving the size precision of the spherical members 51 and the gloss of the surface.

As described above, the conventional spherical member polishing apparatus is required to appropriately recover the supplied working fluid in order to maintain a smooth supply of a necessary and sufficient amount of working fluid.

SUMMARY OF THE INVENTION

The present invention has been made in view of problems associated with a conventional spherical member polishing apparatus. An object of the invention is to provide a spherical member polishing apparatus which can polish a plurality of spherical members with high precision while a variation in polishing precision and the like are avoided as much as possible.

In order to attain the object, there is provided a spherical member polishing apparatus including a first and second disks disposed in opposition to each other with a predetermined clearance, the first disk rotating while pressurizing the spherical members between the first and second disks, the second disk including a plurality of concentric grooves which are formed along a circumferential direction of the second disk, flat portions which are respectively formed between the adjoining concentric grooves, and a plurality of supply ports which are formed along the circumferential direction in at least one of the flat portions and the concentric grooves for supplying working fluid, the spherical members being rollingly polished in the concentric grooves against the first disk.

According to the above-mentioned configuration of the apparatus, a plurality of working-fluid supply ports are formed over an entire area along the circumferential direction in at least either flat portions formed between a plurality of concentric grooves or inside portions of the plurality of concentric grooves, so that working fluid is supplied to all working points for a plurality of spherical members which are polished between the two disks. Accordingly, the polishing is performed without causing the spherical members to be varied in polishing precision, and the spherical members are cooled during the polishing process.

DETAILED DESCRIPTION OF THE PREFERRED EMBODIMENTS

Embodiments of the present invention will be described in detail with reference to the accompanying drawings.

Figure 1:
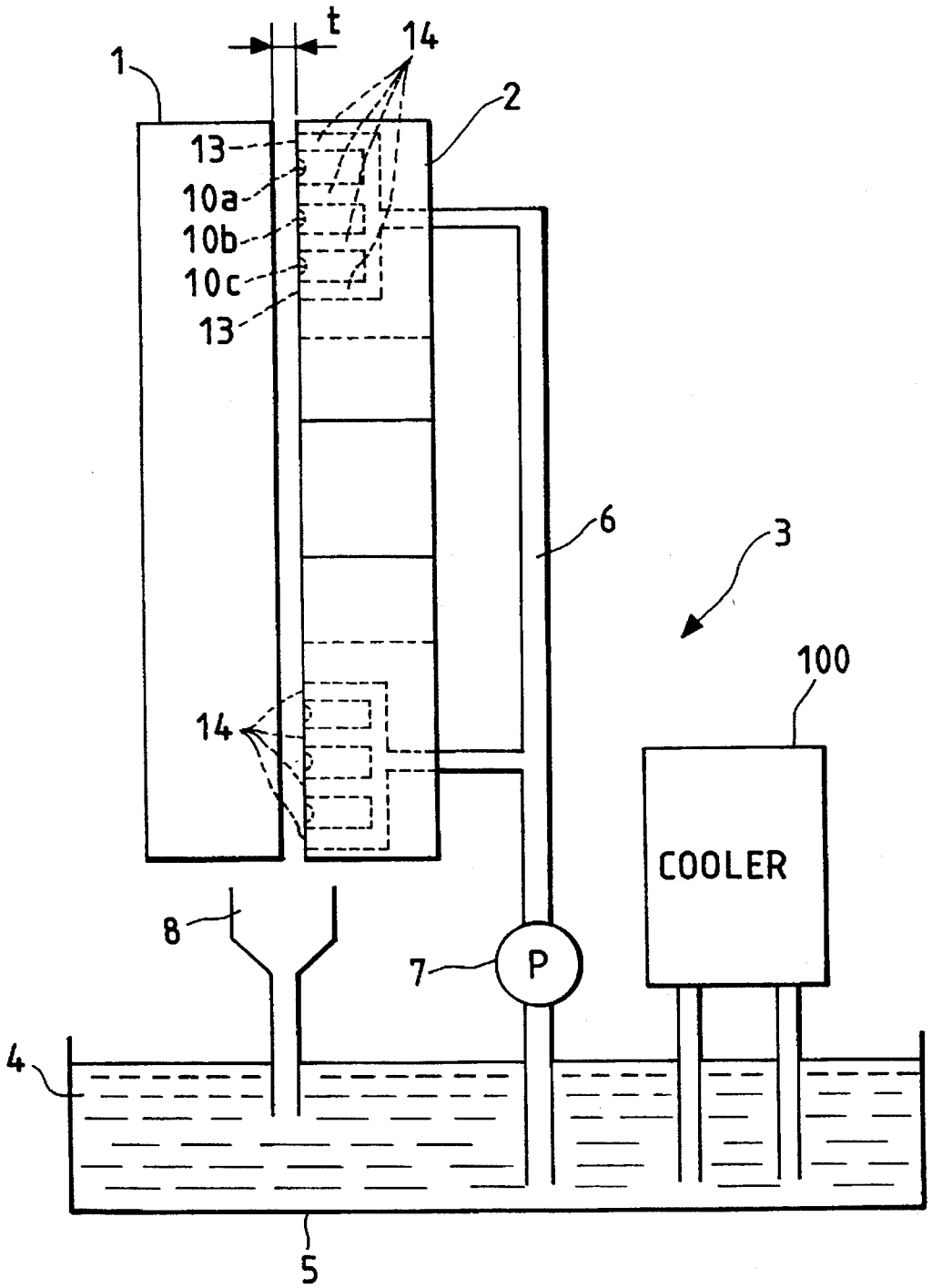
FIG. 1 is a diagram showing the whole structure of a first embodiment of the spherical member polishing apparatus according to the present invention.

FIG. 1 is a diagram showing the whole structure of a first embodiment of the spherical member polishing apparatus according to the present invention. The spherical member polishing apparatus includes a rotating disk 1 rotated by a motor (not shown), a fixed disk 2 disposed in opposition to the rotating disk 1 with a predetermined clearance t, and a working-fluid supplying apparatus 3 for supplying working fluid to the fixed disk 2.

The working-fluid supplying apparatus 3 includes a tank 5 in which a predetermined amount of working fluid 4 (e.g., the trade name "WRAPPING OIL #5" manufactured by IDEMITSU KOSAN CO., LTD.) is stored, a cooler 100 for cooling the working fluid 4, a feed pipe 6 which connects the fixed disk 2 to the tank 5 so as to supply the working fluid 4 to the fixed disk 2, a hydraulic pump 7 interposed in the feed pipe 6, and a funnel-shaped recovering unit 8 for recovering the working fluid 4 supplied to the fixed disk 2 into the tank 5.

Figure 2:
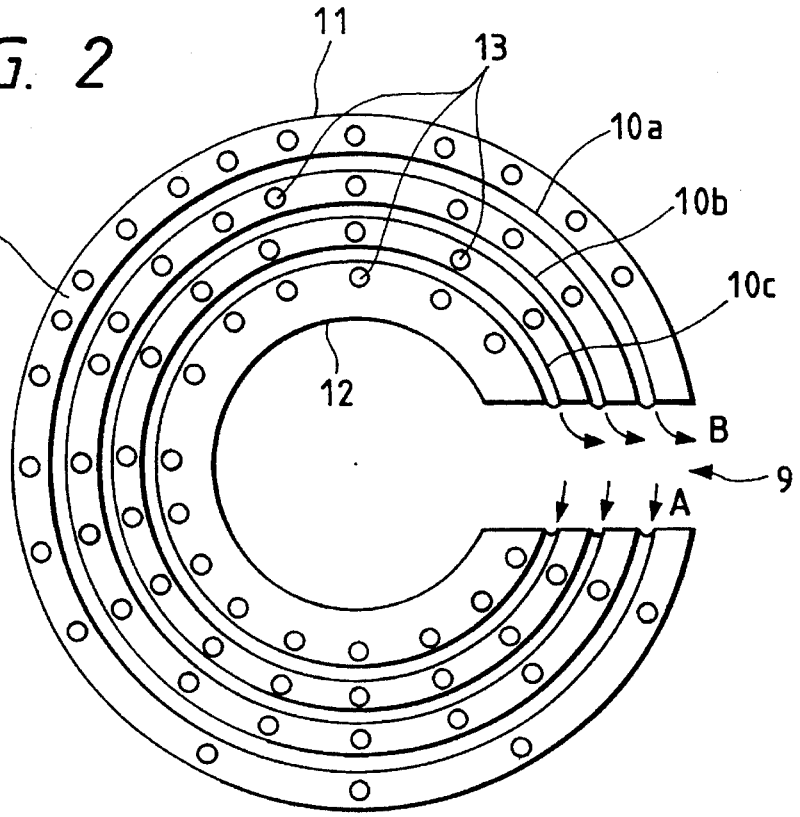
FIG. 2 is a plan view of a fixed disk used in FIG. 1.
Figure 10:
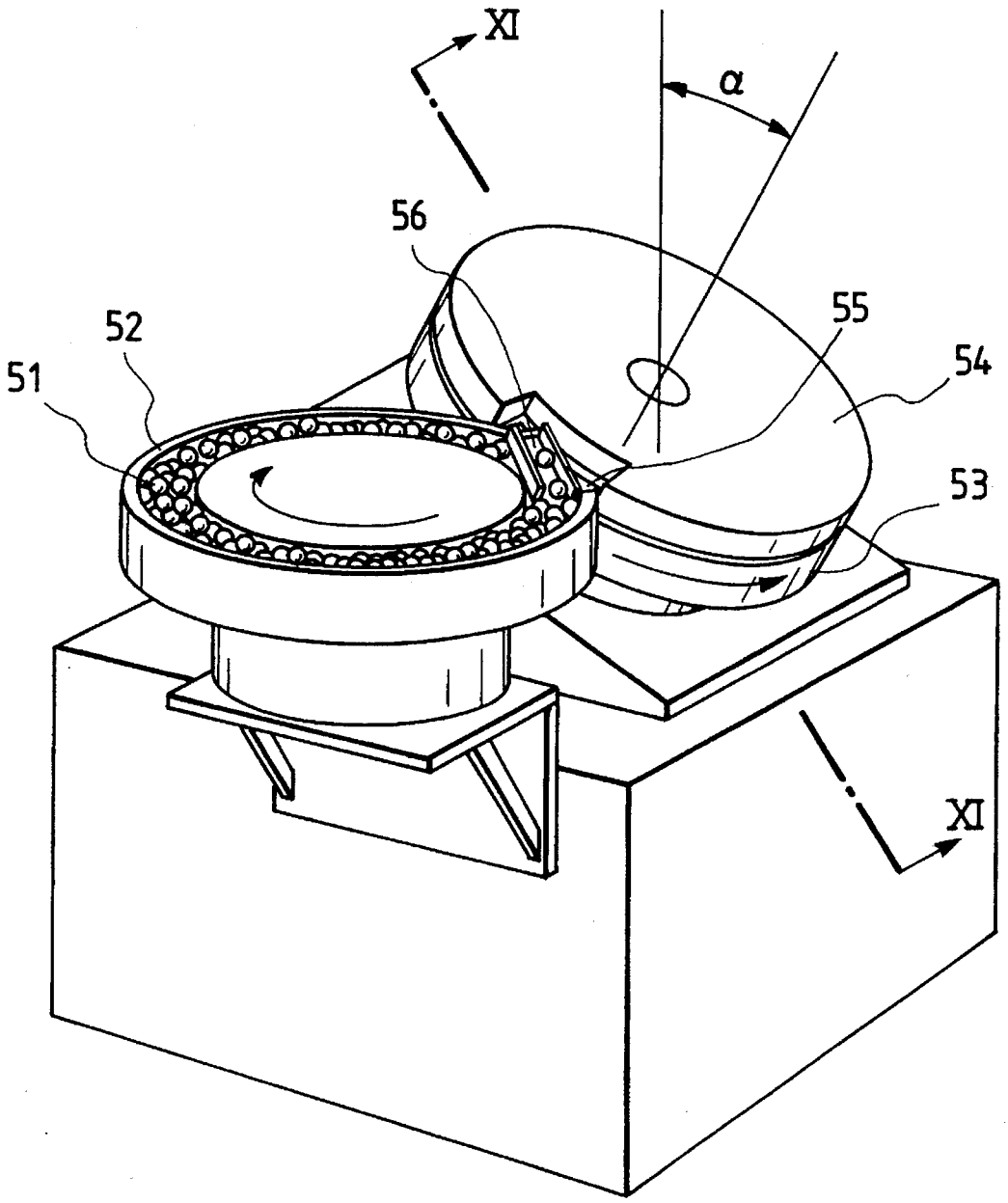
FIG. 10 PRIOR ART
FIG. 10 is a perspective view of the whole of a conventional spherical member polishing apparatus.
Figure 11B:
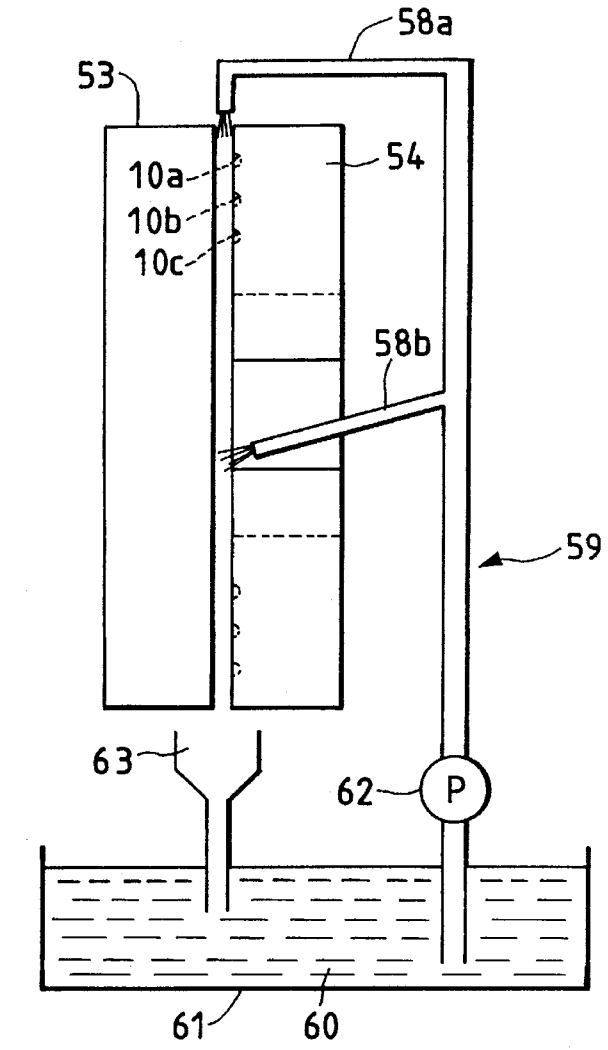
FIG. 11B PRIOR ART
FIGS. 11A and 11B are section views taken along a line indicated by arrows XI—XI in FIG. 10.
Figure 11A:
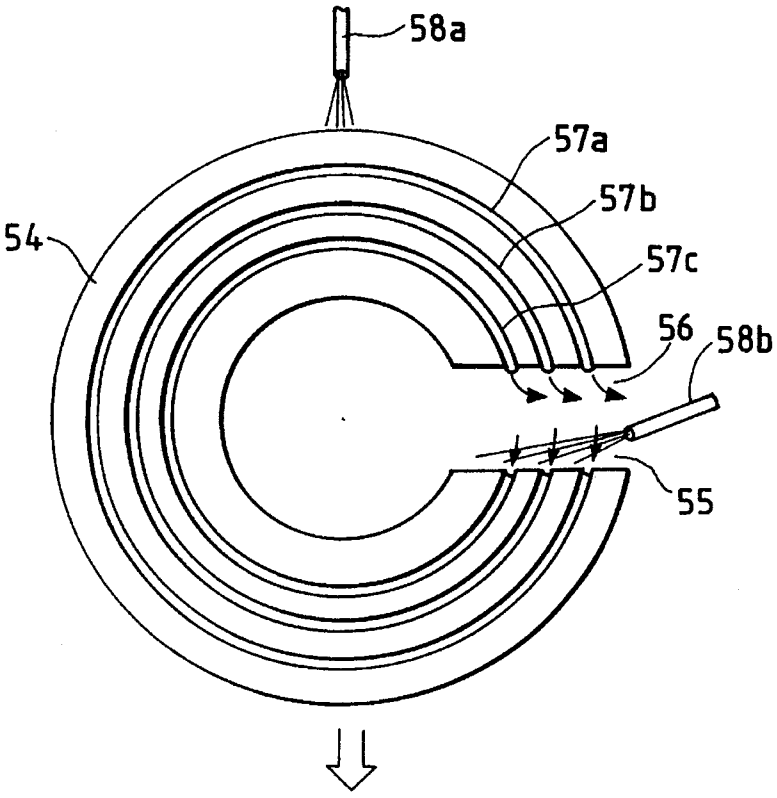
FIG. 11A PRIOR ART

As shown in FIG. 2, the fixed disk 2 is substantially ring-shaped and has a cut-out portion 9. Spherical members which are discharged from a storage (analogous to the storage 52 shown in FIG. 10 but not shown in FIGS. 1 and 2) are supplied in a direction indicated by arrow A and then discharged in a direction indicated by arrow B. Thereafter, the spherical members are recovered into the storage. Three grooves 10*a* to 10*c* are concentrically formed on a flat portion of the fixed disk 2. The number of the grooves 10*a* to 10*c* is not limited to three. A large number of grooves exceeding three can be formed. In addition, the fixed disk 2 includes a plurality of (e.g., thirty or more) working-fluid supply ports 13 which are randomly formed in the circumferential direction over the whole of areas between the grooves 10*a* to 10*c*, between the groove 10*a* and an outer peripheral portion 11 of the fixed disk 2, and between the groove 10*c* and an inner peripheral portion 12 of the fixed disk 2. As shown in FIG. 1, the working-fluid supply ports 13 are communicated with the feed pipe 6 via a plurality of feed-pipe branches 14. The working-fluid supply ports 13 can be arranged in arbitrary positions.

In the spherical member polishing apparatus having the above-mentioned configuration, the working fluid 4 in the tank 5 is pumped up by the hydraulic pump 7, discharged from the working-fluid supply ports 13 via the feed pipe 6 and the feed-pipe branches 14, and then recovered into the tank 5 through the recovering unit 8. The large number of spherical members are pressurized while rolling in the grooves 10*a* to 10*c* in the circumferential direction, so that the spherical members are polished. The working fluid 4 is uniformly supplied over the entire area between the disks 1 and 2 via the working-fluid supply ports 13, so that all the large number of spherical members are uniformly cooled. Thus, it is possible to prevent the quality of the metallic structure from being deteriorated, and the surface hardness from being lowered.

Figure 3:
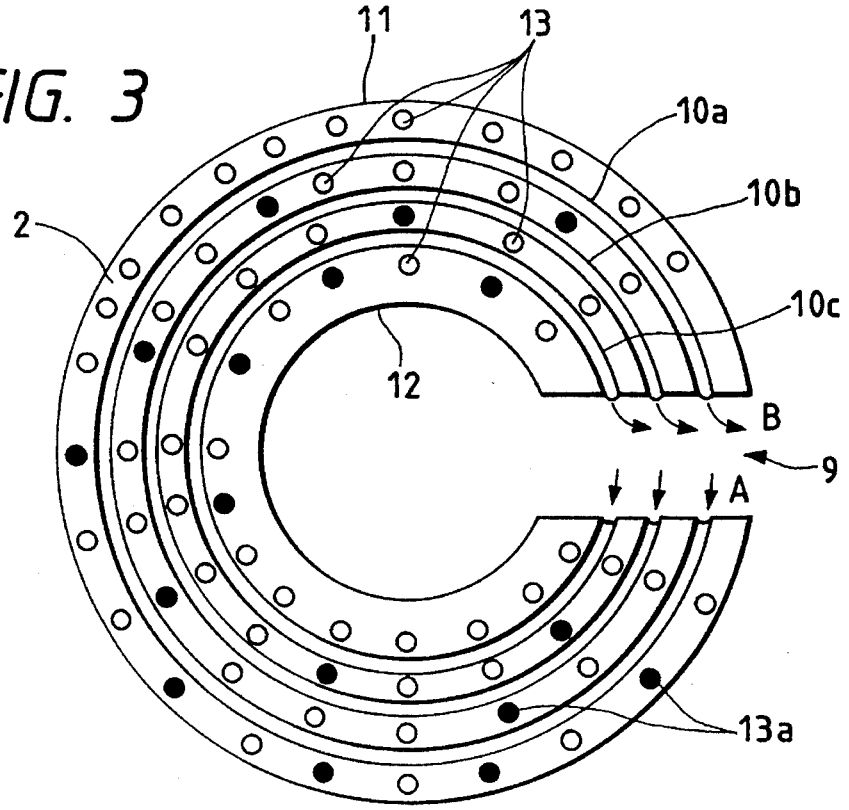
FIG. 3 is a plan view showing a modification of the disk used in FIG. 1.

FIG. 3 shows a modification of the above-described embodiment in which working-fluid recovery ports 13*a* are additionally formed in the fixed disk 2 of FIG. 2. Thus, the working fluid supplied from the working-fluid supply ports 13 can rapidly be recovered after being used in the process of grinding spherical members.

In the spherical member polishing apparatus, a large number of spherical members are ground between the rotating disk 1 and the fixed disk 2. During the grinding process, the working fluid used in the grinding contains shavings of the spherical members, and abrasive grains and abrasion powders dropped from the rotating disk 1 and the fixed disk 2. Consequently, the working fluid containing such materials may produce scratches, deterioration of quality, and dirt on the spherical members, and enter the guiding face for the spherical members, thereby causing the reduction of degree of polishing precision. For these reasons, the working fluid is rapidly recovered in order not to adversely affect the grinding of the spherical members, so that the cleanness of the working fluid can be maintained.

As for the connection of the working-fluid recovering ports 13*a*, a recovered-fluid piping circuit (not shown) which is constructed in the same manner as the feed pipe 6 and the feed-pipe branches 14 may be provided, and a recovering pump (not shown) may be provided in addition to the hydraulic pump 7. A recovered-fluid pipe corresponding to the feed pipe 6 may be connected via a filter (not shown) for circulating the working fluid.

Figure 4:
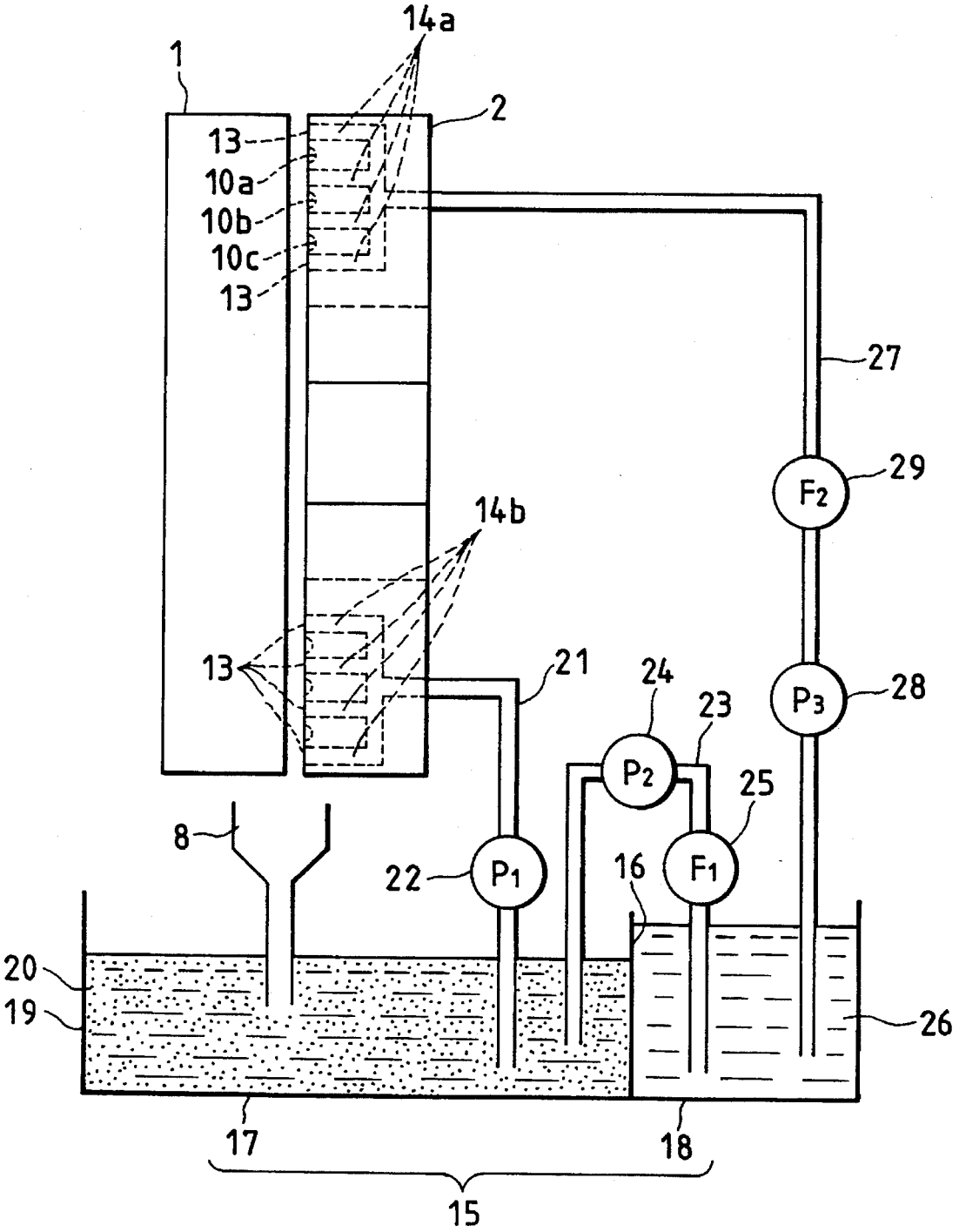
FIG. 4 is a diagram showing the whole structure of a second embodiment of the spherical member polishing apparatus.

FIG. 4 is a diagram showing the whole structure of a second embodiment of the spherical member polishing apparatus according to the present invention. In the second embodiment, working fluid accompanied with free abrasive grains is supplied to the fixed disk 2.

Specifically, in the second embodiment, a tank 15 is divided by a shielding plate 16 into first and second bathes 17 and 18. The first bath 17 stores first working fluid 20 in which free abrasive grains 19 (e.g., Green Carborundum) are suspended.

The first bath 17 and the fixed disk 2 are communicated with each other via a first feed pipe 21. The first working fluid 20 stored in the first bath 17 is pumped up by a first hydraulic pump 22 together with the free abrasive grains 19, and then supplied to the fixed disk 2.

In addition, the first bath 17 and the second bath 18 are communicated with each other via a communicating pipe 23. That is, the first working fluid 20 stored in the first bath 17 is pumped up by a second hydraulic pump 24 interposed in the communicating pipe 23, and then filtered by a first filter 25. As a result, second working fluid 26 which does not contain free abrasive grains is supplied to the second bath 18. The second bath 18 and the fixed disk 2 are connected to each other via a second feed pipe 27. The second working fluid 26 is supplied to the fixed disk 2 via a third hydraulic pump 28 and a second filter 29. As for the second working fluid 26, fine free abrasive grains may pass through the first filter 25 and then supplied to the second bath 18, and also fine free abrasive grains may pass through the second filter 29 and then supplied to the fixed disk 2. However, such fine free abrasive grains do not affect the polished state of the spherical members, and hence the second working fluid 26 can be regarded as not-containing free abrasive grains.

In the second embodiment, spherical members which are introduced between the two disks 1 and 2 are polished with free abrasive grains in a first roll region (the lower regions of the disks 1 and 2) to which the first working fluid 20 is supplied. That is, the free abrasive grains 19 and the first working fluid 20 are uniformly supplied over an entire area of the first roll region. Accordingly, in the first roll region, the spherical members can be polished to the same degree of precision, and sufficiently cooled by the first working fluid 20. The second working fluid 26 which does not contain free abrasive grains is uniformly supplied to the entire area of a second roll region formed in the upper regions of the disks 1 and 2, so that the large number of spherical members can be uniformly cooled. In other words, the first working fluid 20 in which the free abrasive grains 19 are suspended is supplied from working-fluid supply ports 14*b* in the first roll region, and the second working fluid 26 which does not contain free abrasive grains is supplied from working-fluid supply ports 14*a* in the second roll region. Accordingly, in the first roll region, the cooling of the spherical members can be performed together with the polishing using the free abrasive grains. In the second roll region, the cooling of the spherical members and the disks 1 and 2 is performed by the second working fluid 26. Thus, the evenness of the surface of the spherical members can be improved, and the durability of the disks 1 and 2 can be improved.

As described above, according to the second embodiment, the free abrasive grains and the working fluid are uniformly supplied over the entire area of the first roll region, so that a desired polishing process can be performed without causing a local temperature rise. Consequently, it is possible to improve the polishing precision. In the second roll region to which the second working fluid 26 is supplied, the finishing polishing process is performed in a condition that there exist substantially no free abrasive grains, and the spherical members and the disks 1 and 2 are cooled by the sufficient amount of second working fluid 26. Accordingly, the frictional heat generated by the roll polishing can sufficiently be dissipated so that the metallic structure is not deteriorated, thereby preventing the surface hardness from being lowered. Moreover, since also the disks are cooled, the polishing precision for the spherical members can be improved, and it is possible to prevent the disks 1 and 2 from being deformed by the heat. Thus, it is possible to improve the durability of the disks 1 and 2. In the case where the polishing is performed by using a grindstone as the rotating disk 1, the first working fluid 20 in which the free abrasive grains are suspended is supplied between the disks 1 and 2, and therefore the reduction of the time period for shaping the grindstone, and an execution of dressing on the grindstone at an appropriate time can simultaneously be attained.

As described above, in the second embodiment, the free abrasive grains uniformly affect the inside and outside faces of the concentric grooves 10*a* to 10*c*, and a difference in size between spherical members is reduced, and also the variation in precision can be reduced. In addition, since a sufficient amount of working fluid is supplied, the frictional heat is dissipated. Accordingly, there is no reduction of the degree of surface hardness due to the deterioration of the quality of the metallic structure of the spherical members. Moreover, since the frictional heat can be dissipated, it is possible to prevent the disks 1 and 2 from being deformed.

Figure 5:
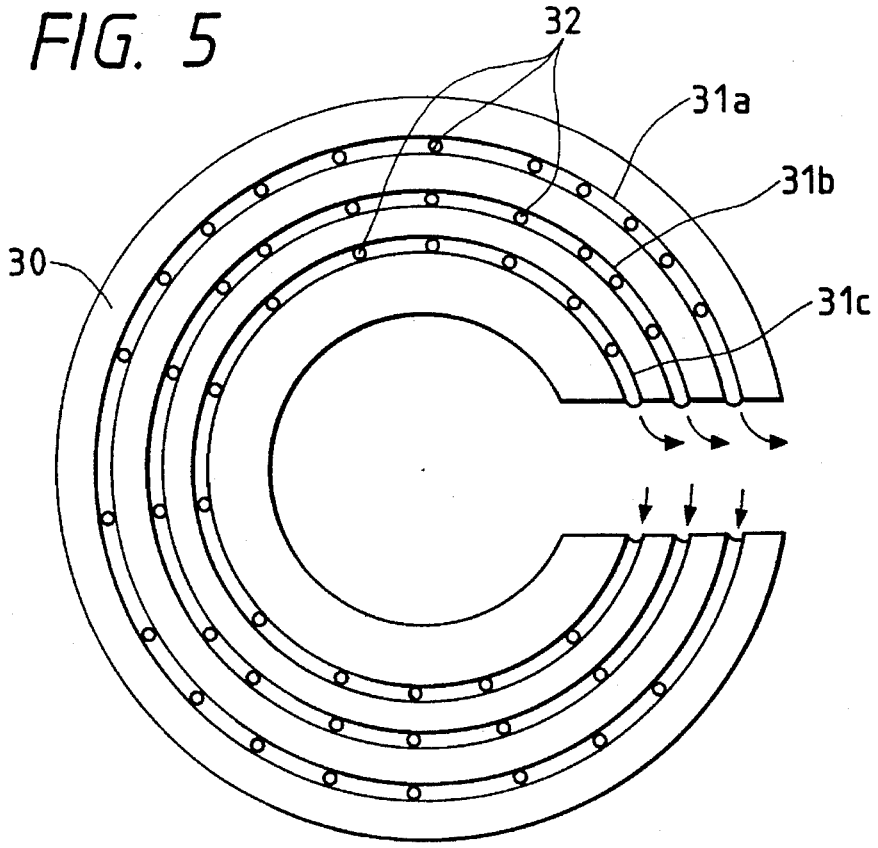
FIG. 5 is a plan view of a fixed disk showing a third embodiment of the spherical member polishing apparatus.
Figure 6:
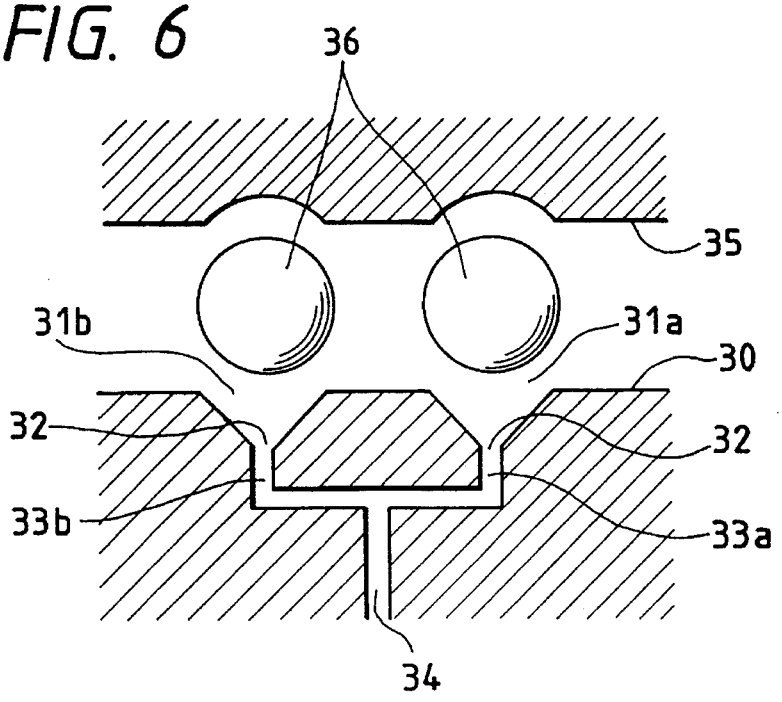
FIG. 6 is an enlarged section view of main portions of the third embodiment.

FIG. 5 is a plan view of a fixed disk showing a third embodiment of the spherical member polishing apparatus according to the present invention. In a flat portion of the fixed disk 30, three V-shaped grooves 31*a* to 31*c* are concentrically formed. In addition, a plurality of (e.g., thirty or more) working-fluid supply ports 32 are randomly formed over an entire area in the circumferential direction in the V-shaped grooves 31*a* to 31*c*. As shown in FIG. 6, feed-pipe branches 33*a* and 33*b* connected to the working-fluid supply ports 32 are constructed in such a manner that they are joined into one feed pipe 34, and working fluid is supplied from a tank (not shown) to the fixed disk 30. In the figure, 35 designates a rotating disk, and 36 designates spherical members.

In the third embodiment, similar to the first and second embodiments, a desired polishing process can be performed, and the working fluid is surely supplied in the V-shaped grooves 31*a* to 31*c* in which the spherical members 36 roll. Accordingly, it is possible to perform a desired polishing process at higher precision.

Figure 7:
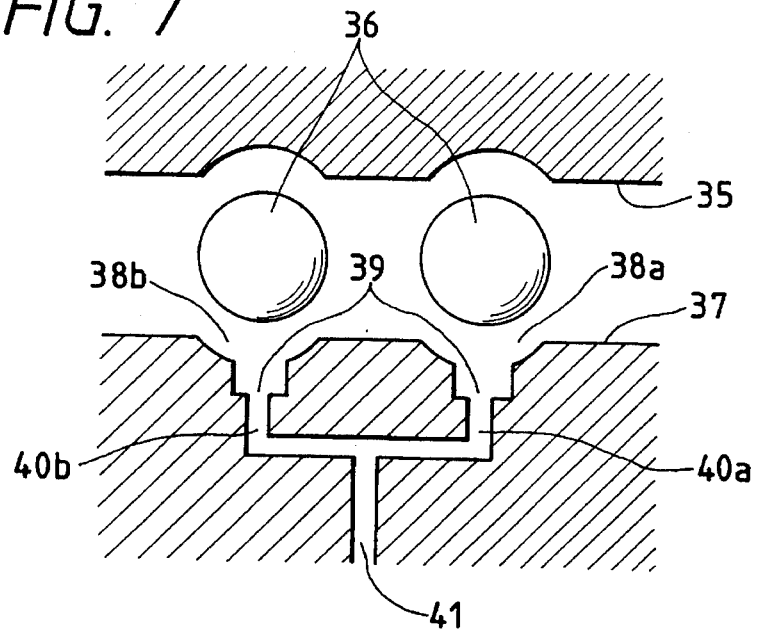
FIG. 7 is an enlarged section view of main portions of a modification of the third embodiment.

FIG. 7 is a plan view of a fixed disk showing a modification of the third embodiment. In the same manner as the first and second embodiments, a plurality of concentric grooves 38*a* and 38*b* are formed on a flat portion of a fixed disk 37. In addition, a plurality of (e.g., thirty or more) working-fluid supply ports 39 are randomly formed over an entire area in the circumferential direction in the respective grooves 38*a* and 38*b*. That is, in the modification, the working-fluid supply ports 39 are formed in a diameter-increasing shape, and feed-pipe branches 40*a* and 40*b* respectively connected to the working-fluid supply ports 39 are joined into one feed pipe 41, so that the same effects and advantages as those described above can be attained.

Figure 8:
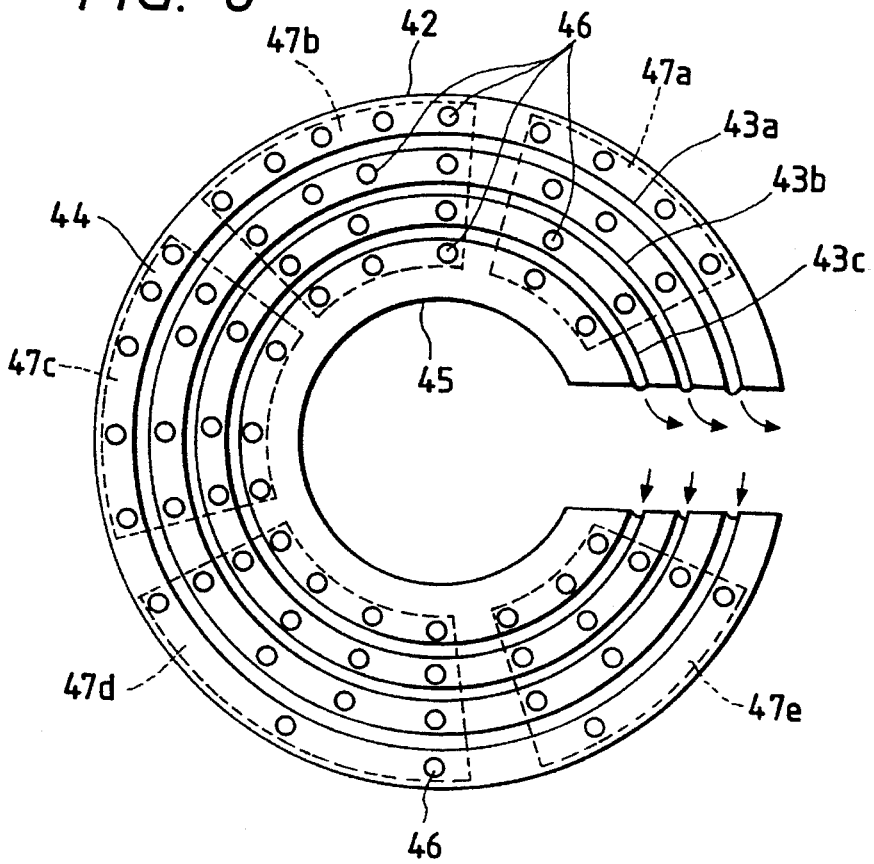
FIG. 8 is a plan view of a fixed disk showing a fourth embodiment of the spherical member polishing apparatus.
Figure 9:
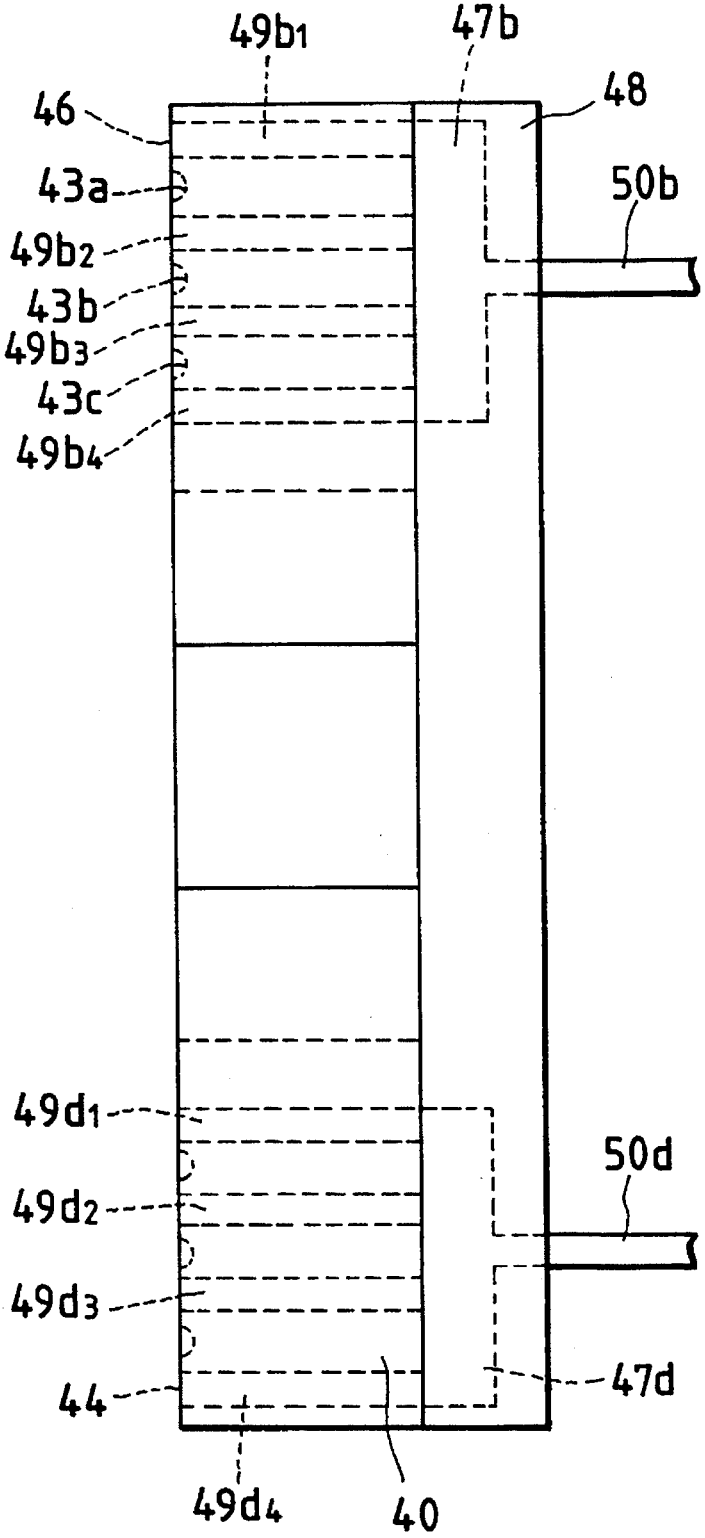
FIG. 9 is a side view of the spherical member polishing apparatus according to the fourth embodiment.

FIG. 8 is a plan view of a fixed disk showing a fourth embodiment of the spherical member polishing apparatus according to the present invention. On a flat portion of the fixed disk 42, similar to the first and second embodiments, a plurality of grooves 43*a* to 43*c* are concentrically formed. In addition, a plurality of (e.g., thirty or more) working-fluid supply ports 46 are randomly formed over a whole area in the circumferential direction between the grooves 43*a* to 43*c*, between the groove 43*a* and an outer peripheral portion 44 of the fixed disk 42, and between the groove 43*c* and an inner peripheral portion 45 of the fixed disk 42. In the fourth embodiment, the working-fluid supply ports 46 are divided into, for example, five working-fluid supply groups 47*a* to 47*e*. That is, in the fourth embodiment, as shown in FIG. 9, a working-fluid supply unit 48 is connected to the back face of the fixed disk 42, and the working-fluid supply unit 48 is divided into the five working-fluid supply groups 47*a* to 47*e*. In each of the working-fluid supply groups 47*a* to 47*e*, feed-pipe branches 49 connected to the working-fluid supply ports 46 are joined into one feed pipe 50, and the working fluid is supplied from a tank which is not shown (in FIG. 9, among the five working-fluid supply groups, feed-pipe branches $49b_1$ to $49b_4$ and $49d_1$ to $49d_4$ belonging to the working-fluid supply groups 47*b* and 47*d*, respectively, are joined into the feed pipes 50*b* and 50*d*).

In the fourth embodiment, the working fluid from the tank is supplied to the working-fluid supply groups 47*a* to 47*e*, so that the composition (a mixed ratio of free abrasive grains, the degree of cleanness, etc.), the supplying pressure, and the like can appropriately be controlled for the working fluid in each of the working-fluid supply groups 47*a* to 47*e*. Thus, a desired polishing process can be performed at a further higher precision.

In the fourth embodiment, the working-fluid supply ports may be formed in the grooves, in the same manner as the third embodiment. Further, the grooves may be formed as V-shaped grooves.

The embodiment in which the working-fluid recovering ports 13*a* are formed in the fixed disk 2 has been described with reference to FIG. 3. This configuration can similarly be applied also to the third embodiment shown in FIGS. 5 to 7, and the fourth embodiment shown in FIGS. 8 and 9.

Moreover, similar to the third embodiment and the modification thereof, in the other embodiments, the rotating disk 1 can include grooves on a flat portion at positions corresponding to the respective grooves of the fixed disk 2, as shown in FIGS. 6 and 7.

As described above in detail, in the spherical member polishing apparatus according to the present invention, a plurality of concentric grooves are formed in the circumferential direction in at least one of the disks, and a plurality of working-fluid supply ports are formed over an entire area along the circumferential direction in at least either flat portions formed between the plurality of concentric grooves or inside portions of the plurality of concentric grooves, so that spherical members can be effectively and sufficiently cooled at all the working points. Thus, there is no reduction of the degree of surface hardness due to the deterioration of the quality of the metallic structure of the spherical members, so that the polishing precision of the spherical members is remarkably improved. In addition, components constituting the apparatus such as disks are simultaneously cooled by the working fluid, so that it is possible to prevent the disks from being deformed by the generation of heat such as frictional heat. As a result, the durability of the apparatus can be improved.

The working fluid can be uniformly and sufficiently supplied to the disks without being locally concentrated, so that the number of operations such as an operation of clearing chips generated during the polishing process can extremely be decreased, thereby improving the operation efficiency.

What is claimed is:

1. In an apparatus for polishing spherical members while supplying working fluid, the apparatus comprising a first and second disks disposed in opposition to each other with a predetermined clearance, the first disk rotating while pressurizing the spherical members between the first and second disks, the second disk including a plurality of concentric grooves which are formed along a circumferential direction of the second disk, flat portions which are respectively formed between the adjoining concentric grooves, the improvement wherein the second disk includes a plurality of supply ports which are formed along the circumferential direction in at least one of the flat portions and the concentric grooves for supplying the working fluid.

2. The apparatus of claim 1, wherein the second disk is substantially ring-shaped and has a cut-out portion formed for supplying and discharging the spherical members.

3. The apparatus of claim 1, wherein the second disk includes a plurality of recovery ports for recovering the working fluid.

4. The apparatus of claim 1, wherein the supply ports are divided into a plurality of supply groups disposed along the circumferential direction, each of the supply groups being applied with a predetermined working condition, and supplied with the working fluid having a composition corresponding to the working condition.

5. The apparatus of claim 2, wherein the supply ports are divided into a plurality of supply groups disposed along the circumferential direction, each of the supply groups being applied with a predetermined working condition, and supplied with the working fluid having a composition corresponding to the working condition.

6. The apparatus of claim 3, wherein the supply ports are divided into a plurality of supply groups disposed along the circumferential direction, each of the supply groups being applied with a predetermined working condition, and supplied with the working fluid having a composition corresponding to the working condition.

* * * * *